US009228478B2

(12) United States Patent
Hildebrand et al.

(10) Patent No.: US 9,228,478 B2
(45) Date of Patent: Jan. 5, 2016

(54) EXHAUST GAS TREATMENT DEVICE

(71) Applicant: EBERSPAECHER EXHAUST TECHNOLOGY GMBH & CO. KG, Neunkirchen (DE)

(72) Inventors: Joachim Hildebrand, Aichwald (DE); Rolf Jebasinski, Filderstadt (DE)

(73) Assignee: EBERSPAECHER EXHAUST TECHNOLOGY GMBH & CO. KG, Neunkirchen (DE)

( * ) Notice: Subject to any disclaimer, the term of this patent is extended or adjusted under 35 U.S.C. 154(b) by 0 days.

(21) Appl. No.: 14/459,746

(22) Filed: Aug. 14, 2014

(65) Prior Publication Data

US 2014/0352287 A1 Dec. 4, 2014

Related U.S. Application Data

(62) Division of application No. 12/938,765, filed on Nov. 3, 2010, now Pat. No. 8,925,308.

(30) Foreign Application Priority Data

Dec. 19, 2009 (DE) ..... 10 2009 059 684

(51) Int. Cl.

| | |
|---|---|
| ***F01N 1/00*** | (2006.01) |
| ***F01N 13/18*** | (2010.01) |
| ***F01N 13/08*** | (2010.01) |

(52) U.S. Cl.

CPC ..... *F01N 13/1811* (2013.01); *F01N 13/08* (2013.01); *F01N 13/185* (2013.01); *F01N 13/1816* (2013.01); *F01N 2470/02* (2013.01); *F01N 2470/24* (2013.01)

(58) Field of Classification Search

CPC ... F01N 13/08; F01N 13/185; F01N 13/1816; F01N 13/1811

USPC ..... 60/322, 324

See application file for complete search history.

(56) References Cited

U.S. PATENT DOCUMENTS

| | | | |
|---|---|---|---|
| 1,993,397 | A | 3/1935 | Berg et al. |
| 2,213,614 | A | 9/1940 | Scarritt |
| 2,251,369 | A | 8/1941 | Moss |
| 3,196,976 | A | 7/1965 | Powers et al. |
| 3,262,516 | A | 7/1966 | Borgeson |

(Continued)

FOREIGN PATENT DOCUMENTS

| | | |
|---|---|---|
| DE | 1 476 634 | 2/1969 |
| DE | 1 933 339 | 1/1971 |

(Continued)

*Primary Examiner* — Jason Shanske

(74) *Attorney, Agent, or Firm* — Greer, Burns & Crain, Ltd.

(57) ABSTRACT

The invention relates to an exhaust gas treatment device for an exhaust system of a combustion engine, more preferably of a road vehicle, with a housing enveloping at least one interior space, and with at least one through-pipe penetrating the interior space without interruption and which at two fastening points distant from each other is connected to the housing in a fixed manner. For compensating thermally related expansion effects the through-pipe between the fastening points can comprise at least one expansion compensation section, in which a wall of the through-pipe comprises slits penetrating the wall alternating in circumferential direction and strips protruding relative to adjacent wall sections of the through-pipe.

21 Claims, 4 Drawing Sheets

(56) References Cited

U.S. PATENT DOCUMENTS

Figure 1:
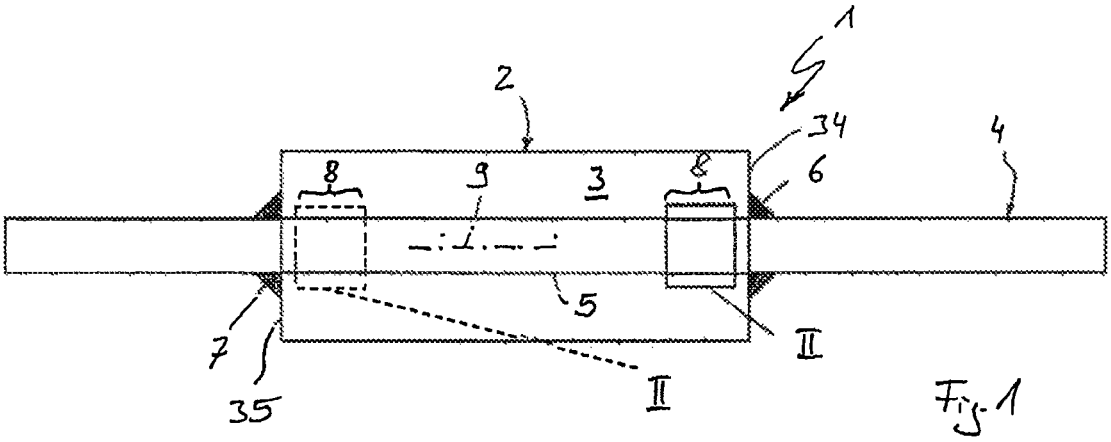

| | | | | |
|---|---|---|---|---|
| 3,415,336 | A | 12/1968 | Arthur et al. | |
| 3,523,590 | A | 8/1970 | Straw | |
| 5,140,814 | A | 8/1992 | Kreutmair et al. | |
| 5,799,395 | A * | 9/1998 | Nording | F01N 13/08 29/890.036 |
| 6,826,834 | B2 | 12/2004 | Wu et al. | |
| 6,889,500 | B1 | 5/2005 | Martinez | |
| 7,444,806 | B2 | 11/2008 | Werber et al. | |
| 2006/0013746 | A1 * | 1/2006 | Bien | F01N 3/2882 422/179 |
| 2006/0059674 | A1 * | 3/2006 | Williams | B64D 41/00 29/402.08 |
| 2009/0158720 | A1 * | 6/2009 | Krause | F01N 1/084 60/297 |

FOREIGN PATENT DOCUMENTS

| | | |
|---|---|---|
| DE | 1933339 | 1/1971 |
| EP | 0503580 A1 | 9/1992 |
| EP | 1510668 | 3/2005 |
| JP | 59102919 | 7/1959 |
| JP | 8-218860 | 8/1996 |
| JP | 2004316564 | 11/2004 |

* cited by examiner

EXHAUST GAS TREATMENT DEVICE

This application is a Divisional of U.S. patent application Ser. No. 12/938,765, filed Nov. 3, 2010.

The present invention relates to an exhaust gas treatment device for an exhaust system of a combustion engine, more preferably of a road vehicle.

An exhaust gas treatment device can for example be configured as catalytic converter or as particle filter or as silencer or comprise any combination of such devices. At any rate, such an exhaust gas treatment device usually has a housing which at least envelops one interior space. For certain applications, particularly in the case of silencers, passing at least one through-pipe through the interior space without interruption can be required, wherein this through-pipe is then held in two positions in the housing which are distant from each other. For example the through-pipe penetrates two bottoms of the housing spaced from each other, which laterally stabilise the through-pipe.

To reduce or avoid stresses between the through-pipe and the housing due to thermally-related expansion effects it is usual to fasten the through-pipe only to one of the bottoms, while on the other bottom it is held axially moveable via a sliding seat.

Such sliding seat solutions are problematic, since a sliding seat can jam due to contaminations. Moreover, tolerance-related dimensional deviations in the sliding seat can create excessive play, which can result in transverse movements and thus noise development. In the case of excessive play, radial support for the mechanically loaded pipe is additionally absent. This results in a higher load on the welded joint between the respective pipe and the housing.

The present invention deals with the problem of stating an improved or at least another embodiment for an exhaust gas treatment device wherein a continuous pipe arrangement is supported in a housing, which embodiment is more preferably characterized in that it at least avoids one of the mentioned disadvantages of a sliding seat solution.

According to the invention, this problem is solved through the subjects of the independent claims. Advantageous embodiments are the subject of the dependent claims.

The present invention is based on the general idea of equipping a wall of the respective pipe with strips which are adjacent to one another in circumferential direction, which are designed spring-elastically radially to the longitudinal centre axis of the respective pipe and thereby stand away from the remaining pipe to the outside or to the inside. Because of this, the strips form elements which yield spring-elastically in radial direction. According to a first solution of the present invention this can be utilised to cushion axial forces which can act on the through-pipe if the latter for example is connected to the housing in a fixed manner on both sides of the region equipped with the strips. On the other hand the spring-elastic strips make possible realising a sliding seat with a second solution of the present invention, wherein the pipe via the radially spring-elastic strips is supported on the other pipe under radial preload. Tolerance-related dimensional deviations can be offset through the spring-elastic strips, as a result of which the risk of noise development can be significantly reduced. Furthermore, the strips touch the respective other pipe only in a very small contact region, as a result of which the risk of jamming of the pipes in the sliding seat is also substantially reduced.

According to the first solution mentioned above, the at least one through-pipe is connected to the housing in a fixed manner in two fastening points distant from each other, wherein said through-pipe between these fastening points comprises at least one expansion compensation section having the mentioned spring-elastic strips. To this end, slits and strips are formed in the expansion compensation section in a wall of the through-pipe which alternate with one another in circumferential direction. While the slits penetrate the wall of the through-pipe, the strips stand proud relative to adjacent wall sections of the through-pipe.

According to the above-mentioned second solution, the housing of the exhaust gas treatment device contains two pipes mounted longitudinally displaceable on each other via a sliding seat, wherein one of the pipes in the sliding seat comprises a spring section having the spring-elastic strips. To this end, a wall of the respective pipe comprises a plurality of strips adjacent in circumferential direction, which with regard to the longitudinal centre axis of the pipe present in the spring section radially bear against the other pipe in a spring-elastic manner.

According to an advantageous embodiment the strips in the spring section can be formed in that the wall in the spring section is interrupted in circumferential direction by a plurality of slits penetrating the wall, while the strips with respect to adjacent wall sections of the respective pipe stand proud. Insofar this spring section can basically be configured identically to the expansion compensation section of the first solution.

Alternatively, it is likewise possible to form the strips of the spring section in that in the spring section in the wall adjacently in circumferential direction, a plurality of strip-shaped wall sections are cut clear and flared out. The respective clear cut contour borders the respective strip-shaped wall section on three sides while merely on the fourth side it remains connected to the remaining wall of the pipe in a fixed manner. Through forming, the wall section cut clear to that extent is then flared out. In contrast with the embodiment described before, the slits there delimit only one side of adjacent strips in each case. In addition, the strips there are each connected to the wall of the through-pipe in a fixed manner on two sides spaced from each other in the region of the slit ends.

The strips, regardless of whether these were created with the help of slits or with the help of clear cut contours, can be curved wave-like or bent zigzag-shaped. A wave-shaped curvature is preferred since the risk of elevated stress peaks with compact, design is reduced there. In addition, it is preferred to simply curve or bend the strips to the outside or to the inside with respect to a longitudinal centre axis of the respective pipe. It is likewise possible in principle to multiply curve or bend the strips so that each of these with respect to the longitudinal centre axis of the respective pipe comprise at least one region curved or bent to the outside and at least one region curved or bent to the inside.

With a cost-effective embodiment the strips can be curved one-way or two-dimensionally so that they are only curved with respect to a longitudinal direction of the respective pipe. Alternatively, the strips with a slightly more expensive embodiment can be two-way or three-dimensionally curved, so that they are curved both with respect to the longitudinal direction as well as transversely thereto, i.e. in circumferential direction.

Additional important features and advantages of the invention are obtained from the subclaims, from the drawings and from the associated figure description by means of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters refer to same or similar or functionally same components.

Figure 2:
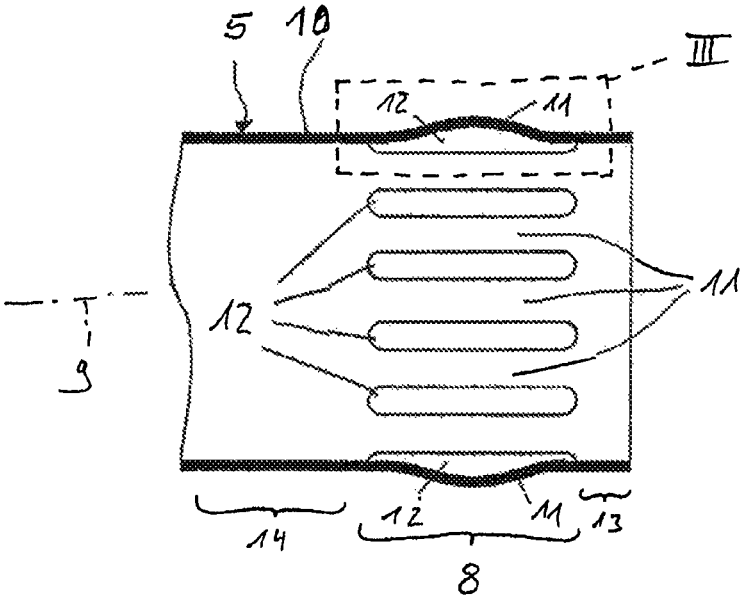
Figure 3:
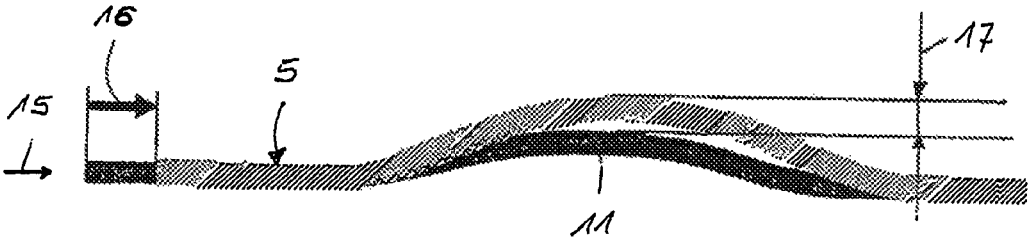
Figure 4:
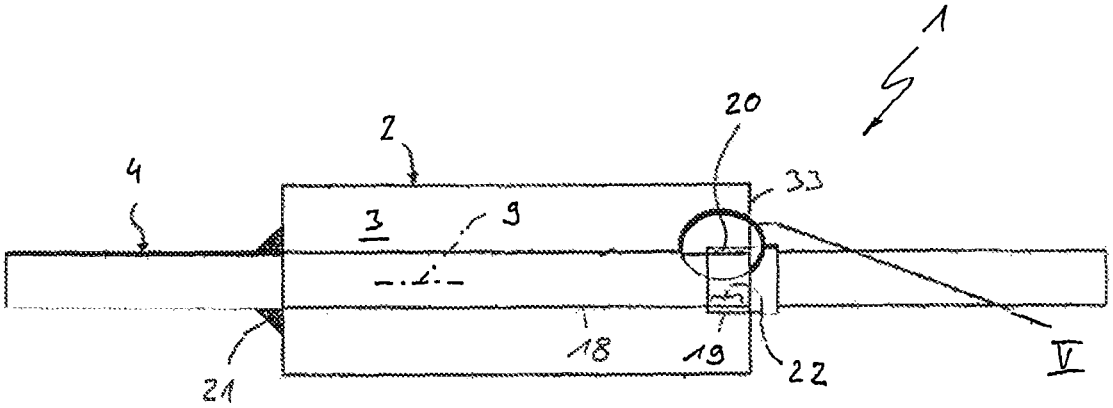
Figure 5:
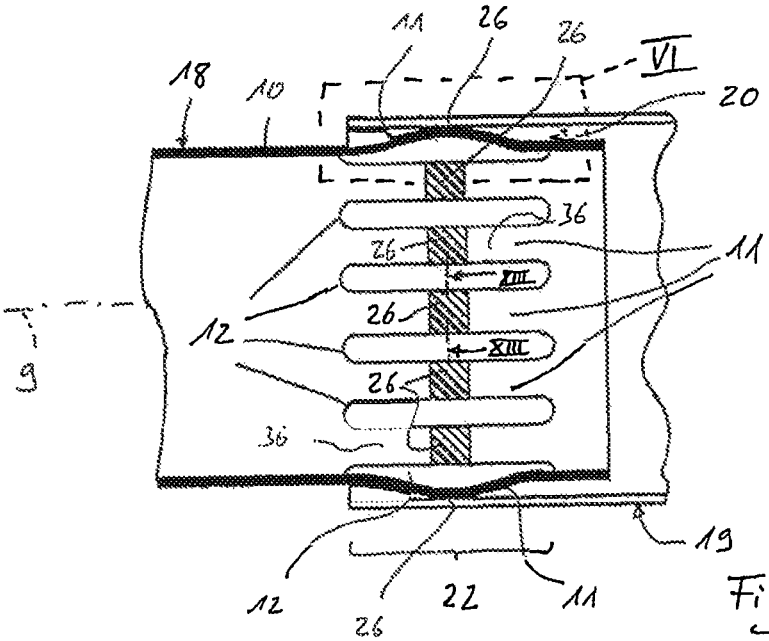
Figure 6:
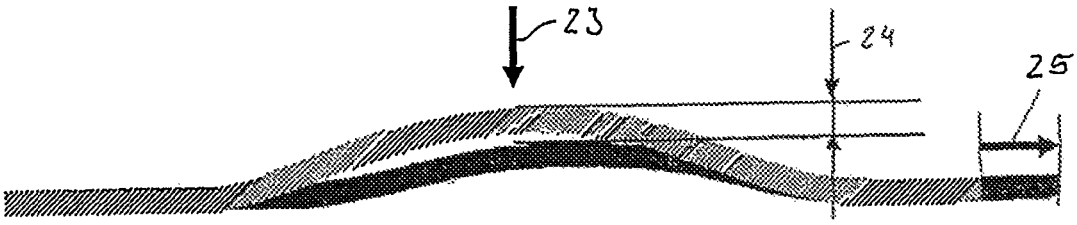
Figure 7:
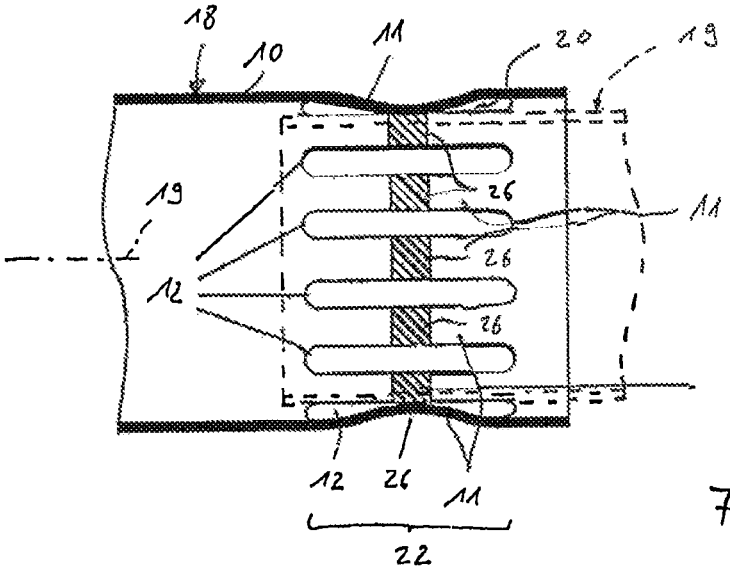
Figure 8:
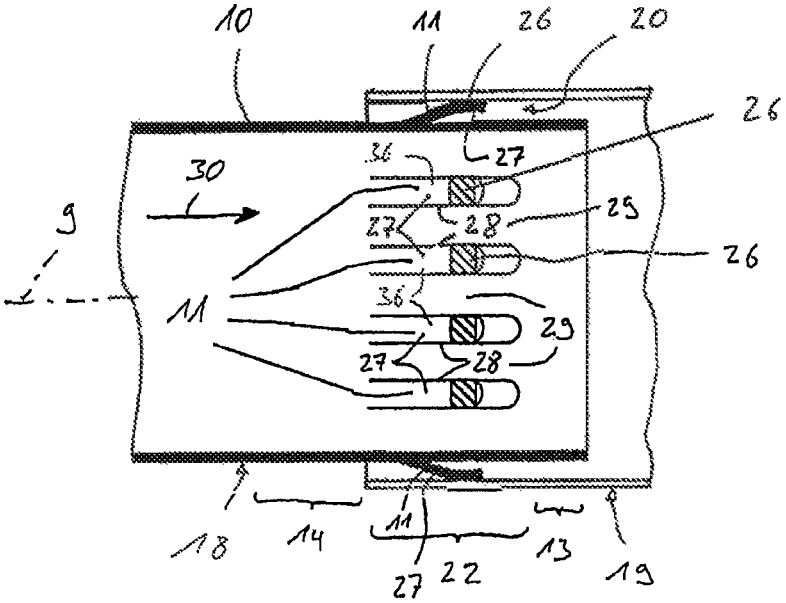
Figure 11:
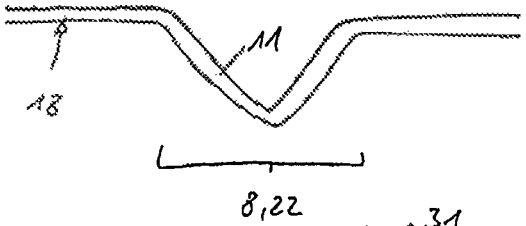
Figure 12:
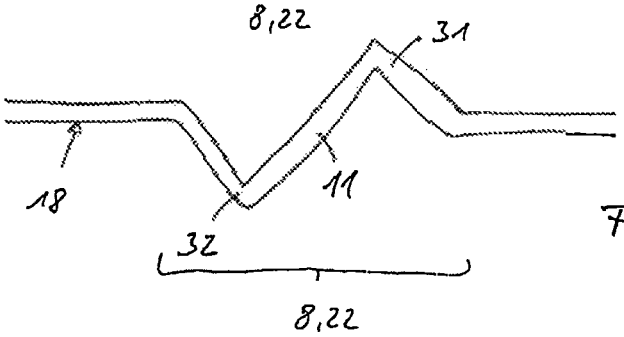
Figure 13:
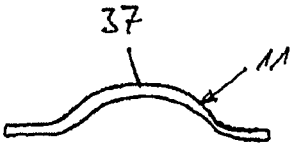
Figure 14:
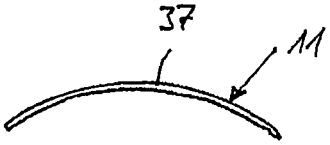

It shows, in each case schematically,

FIG. 1 a greatly simplified elementary longitudinal section of an exhaust gas treatment device according to a first embodiment, FIG. 2 an enlarged detail II from FIG. 1 in the region of an expansion compensation section, FIG. 3 an enlarged detail III from FIG. 2 in the region of a strip of the expansion compensation section, FIG. 4 a view as in FIG. 1, however with a second embodiment of the exhaust gas treatment device, FIG. 5 an enlarged detail V from FIG. 4 in the region of a spring section, FIG. 6 an enlarged detail VI from FIG. 5 in the region of a strip of the spring section, FIG. 7 a detail view as in FIG. 5, however with a further embodiment, FIG. 8 a detail view as in FIG. 7, however with another embodiment, FIG. 9-12 greatly simplified detail views of a strip with different other embodiments, FIG. 13-14 a simplified cross section each through a strip according to section lines XIII from FIG. 5, with different embodiments.

According to FIG. 1, an exhaust gas treatment device 1 comprises a housing 2, enveloping at least one interior space 3. The exhaust gas treatment device 1 is provided for an exhaust system 4 of a combustion engine—only partially visible here—which more preferably can be arranged in a road vehicle. The exhaust gas treatment device 1 can be a catalytic converter, such as for instance an oxidation catalytic converter or a NOX storage catalytic converter or an SCR-catalytic converter. The exhaust gas treatment device 1 can likewise be a particle filter, more preferably a soot filter. Furthermore, the exhaust gas treatment device 1 can be a silencer. It can likewise concern basically any combination of catalytic converter, particle filter and/or silencer. In particular, FIGS. 1 and 4 each show only a part of the exhaust gas treatment device 1.

With the embodiment shown in FIG. 1 the exhaust gas treatment device 1 comprises at least one through-pipe 5 which is passed through the interior space 3 without interruption, i.e. penetrates the interior space 3 without interruption. Furthermore, the through-pipe 5 is connected to the housing 2 in a fixed manner at two fastening points 6 and 7 distant from each other. The fastening points 6, 7 can be realised through welded connections.

Between the fastening points 6, 7 the through-pipe 5 at least comprises one expansion compensation section 8 which in FIG. 1 is indicated by a brace. With respect to a longitudinal centre axis 9 of the through-pipe 5 the expansion compensation section 8 is a longitudinal section or axial section. In the example of FIG. 1, two such expansion compensation sections 8 are indicated which can be realised alternatively or cumulatively.

According to FIG. 2, the respective expansion compensation section 8 is characterized in that therein a wall 10 of the through-pipe 5 comprises a plurality of strips 11 and a plurality of slits 12 which alternate with respect to the longitudinal axis 9 in circumferential direction. The slits 12 penetrate the wall 10. The strips 11 stand proud with respect to the adjacent wall sections 13 and 14 of the through-pipe 5. Practically, the strips 11 are geometrically shaped so that they spring-elastically absorb tensile forces and compressive forces acting in the through-pipe 5. Such forces can be introduced into the through-pipe 5 via the fastening points 6, 7. For example, thermally related expansion effects can result in that the through-pipe 5 expands faster and/or more intensively than the housing 2, as a result of which the mentioned forces can materialise.

In FIGS. 2 and 3 the strips 11 are wave-shaped and simply curved to the outside. FIG. 3 illustrates the manner of operation of the strips 11. A compressive force 15 indicated by an arrow 15 results in compression 16 of the through-pipe 5. The strips 11 can be elastically dented outward and in the process carry out a stroke 17 which offsets the compression 16 or spring-elastically absorbs the compressive force 15. When the compressive force 15 diminishes, the compression 16 also decreases as a result of which the stroke 17 also spring-elastically diminishes. The same in reverse order applies to tensile forces.

According to FIG. 1, the fastening points 6, 7 on the housing side 2 are provided on end bottoms 34, 35 of the housing 2. It is clear that with another configuration the bottoms 34, 35 can also be bottoms located inside, i.e. bottoms arranged in the interior of the housing 2.

FIG. 4 shows another embodiment of the exhaust gas treatment device 1. It differs from the embodiment shown in FIG. 1 in that no through-pipe 5 fastened to the housing 2 via two fastening points 6, 7 is present, but that in the housing 2 two pipes 18, 19 are mounted on each other longitudinally displaceable via a sliding seat 20. The one pipe 18, which in the following is also designated first pipe 18, can be connected to the housing 2 in a fixed manner via a fastening point 21. The fastening point 21 can for example be realised by means of a welded connection. The other pipe 19, which in the following is also designated second pipe 19, can likewise be attached to the housing 2 in a fixed manner. The two pipes 18, 19 are coaxially inserted into each other in the sliding seat 20.

The in FIG. 4 shorter second pipe 19 can also be formed by a pipe socket formed on a wall 33 of the housing 2. This pipe socket 19 can also be integrally moulded on this wall 33.

One of the pipes 18, 19 in the sliding seat 20 comprises a spring section 22 which in FIG. 4 is indicated by a brace. According to FIG. 5, this spring section 22 is characterized in that it has a plurality of strips which in the following are likewise designated 11. These strips 11 are arranged adjacently in circumferential direction with respect to the longitudinal axis 9. Furthermore, they are configured spring-elastically in radial direction relative to the longitudinal centre axis 9. Furthermore, they bear against the respective other pipe 18, 19 more preferably under radial preload.

With the embodiments of FIGS. 5, 7 and 8 the respective first pipe 18 is equipped with this spring section 22. With the embodiments shown in FIGS. 5 and 8 the first pipe 18 is inserted into the second pipe 19 and in the sliding seat 20 thus forms a pipe 18 located inside. The strips 11 with these embodiments are then shaped so that they stand away to the outside from the first pipe 18 and come to bear radially preloaded against the second pipe 19 located outside. In contrast with this, FIG. 7 shows another embodiment, wherein the first pipe 18 is fitted onto the second pipe 19 on the outside and accordingly in the sliding seat 20 forms the pipe 18 located outside. In this case the strips 11 are shaped so that they protrude to the inside in the direction of the second pipe 19 located inside and come to bear against said pipe in a radially preloaded manner. With respect to the shaping of the strips 11 FIG. 7 also refers to the embodiment of FIG. 5. It is clear that this configuration with strips 11 preloaded to the inside can also be realised with the embodiment of the strips 11 shown in FIG. 8.

The manner of operation of the spring section 22 is explained in FIG. 6. Although FIG. 6 relates to the embodiment shown in FIG. 5, it can similarly be applied also to the embodiments shown in FIGS. 1 and 8.

The strips 11 are geometrically shaped so that prior to pushing together of the pipes 18, 19 in the sliding seat 20 in the spring section 22 they define a circumcircle located outside, whose cross section is greater than the free cross section of the second pipe 19, into which the first pipe 18 equipped with the spring section 22 is to be inserted. Insofar as the first pipe 18 as in FIG. 7 is to be fitted on to the second pipe 19, the strips 11 are then similarly shaped so that prior to the pushing together of the pipes 18, 19 in the sliding seat 20 they define a circumcircle located inside, whose cross section is smaller than the outer cross section of the second pipe 19.

In any case, the pushing-together operation according to FIG. 6 results in a radial force 23 indicated by an arrow, which spring-elastically deforms, that is compresses or flattens the strips 11. As a result of this, a stroke change 24 results, by which the resilient strips 11 elastically yield in radial direction. This stroke change 24 results in a change in length 25 of the first pipe 18 indicated by an arrow. Since the strips 11 deform elastically, the change in length of the pipe 18 is also elastic. Since the strips 11 yield spring-elastically, the deformation leads to a resetting spring force which generates a radial preload with which the strips 11 bear against the other pipe 19.

As is evident from FIGS. 13 and 14, curving or arching the respective strip 11 not only in one way, but two ways can be optionally provided. The strips 11 curved one-way or only two-dimensionally are curved or arched only with respect to the longitudinal direction. The strips 11 curved two-ways or three-dimensionally are additionally curved or arched also with respect to the circumferential direction. This can be realised in this way with all sliding seats 20. The arch or curvature with respect to the circumferential direction is designated 37 in FIGS. 13 and 14. In the case of the profile of FIG. 13 the arch 37 has two turning points. In the case of the profile of FIG. 14 the arch 37 is free of turning points.

According to FIGS. 5, 7 and 8 the shaping of the strips 11 additionally results in that the strips 11 are in contact with the respective other pipe 19 only via comparatively small contact areas 26. On the other hand, the risk of jamming of the two pipes 18, 19 in the sliding seat 20 is substantially reduced.

The respective contact area 26 in this case is smaller than an area 36 of the respective strip 11 facing the other pipe 19. For example, the contact area 26 of the respective strip 11 takes up a maximum of 30% or a maximum of 25% or a maximum of 20% or a maximum of 15% or a maximum of 10% or a maximum of 5% of the area 36 of the respective strip 11. With one-way curvature or arch of the respective strip 11, a reduction of the respective contact area 26 to a line extending in circumferential direction is preferred. Provided that the curvature or arch of the respective strip 11 is realised two-ways or three-dimensionally, the respective contact area 26 is preferentially reduced to a dot.

With the embodiment shown in FIGS. 5 to 7, the strips 11 are realised in that a wall, in the following likewise designated 10, of the respective pipe, in this case of the first pipe 18 in the spring section 22 is interrupted through a plurality of slits, in the following likewise designated 12. The slits 12 penetrate the wall 10. The slits 12 and the strips 11 alternate in circumferential direction. In the example of FIG. 5 the spring section 22 is formed on the pipe 18 located inside in the sliding seat 20, so that the strips 11 protrude to the outside. In contrast with this, the spring section 22 with the embodiment shown in FIG. 7 is formed on the pipe 18 located outside in the sliding seat 20, so that there the strips 11 protrude to the inside.

The spring section 22 of the embodiments shown in FIGS. 5 to 7 can basically be configured identically in design to the expansion compensation section 8 of the embodiment shown in FIGS. 1 to 3.

FIG. 8 now shows another embodiment for realising the spring section 22. In this case, the strips 11 are realised in that in the spring section 22 in a wall, which in the following is likewise designated 10, of the respective pipe, in this case of the first pipe 18, a plurality of strip-shaped wall sections 27 are cut clear with the help of cuts 28 and flared out. The cuts 28 can more preferably be designed U-shaped. At any rate, they enclose the strip-shaped wall sections 27 on three sides, as a result of which the wall sections 27 can be flared out in order to form the strips 11. Between adjacent flared-out strips 11, additional strip-shaped wall sections 29 are present in the spring section 22 with this embodiment, which connect wall sections of the pipe 18 adjacent to the spring section 22, which in this case are likewise designated 13 and 14, with each another. Such strip-shaped wall sections 29, which connect the adjacent wall sections 13, 14 with each other and which are present in addition to the flared-out strips 11, are absent from the embodiments shown in FIGS. 5 to 7. There, this connecting function is assumed by the strips 11, which are connected to both adjoining wall sections 13, 14.

In the shown example of FIG. 8, the spring section 22 is formed on the pipe 18 located inside in the sliding seat 20, so that the strips 11 are flared to the outside.

Alternatively it is likewise possible to form the spring section 22 on the pipe located outside in the sliding seat 20, so that the strips 11 are then flared to the inside. With regard to an exhaust gas flow direction 30 indicated by an arrow in FIG. 8, the strips are cut clear in this case such that their end on the leading side is connected to the wall 10 in a fixed manner. It is clear that with another embodiment an obverse design can also be realised, so that an end of the strips on the trailing side can be connected to the wall 10 in a fixed manner.

The respective through-pipe 5 or the respective pipe 18, 19 in each of the shown embodiments purely as example has a constant cross section outside the expansion compensation section 8 or outside the spring section 22. It is clear that with other embodiments varying cross sections can also be realised here. More preferably, the respective pipe 5, 18, 19 can also be a funnel.

With the embodiments shown in FIGS. 1 to 8, the strips 11 are each wave-shaped and curved one-way regardless of their realisation shape. FIGS. 9 to 12 indicate other geometries for the strips 11, however without claiming completeness. The different shapes for the strips 11 shown in FIGS. 9 to 12 can likewise be realised within the expansion compensation section 8 as in the spring section 22. These, too, cannot only be realised for the strips 11 connected on both sides to the wall 10 of the embodiments according to FIGS. 2, 5 and 7, but also for the strips 11 merely connected to the wall 10 on one side of the embodiment according to FIG. 8.

Figure 9:
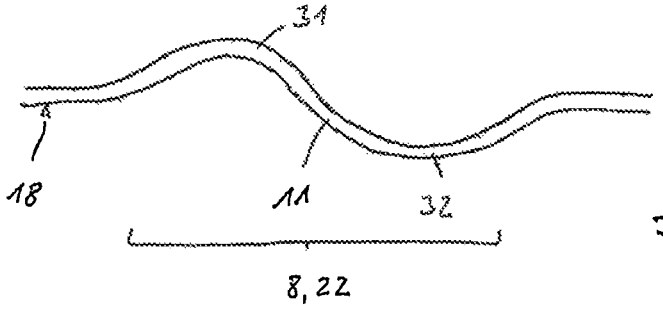
Figure 10:
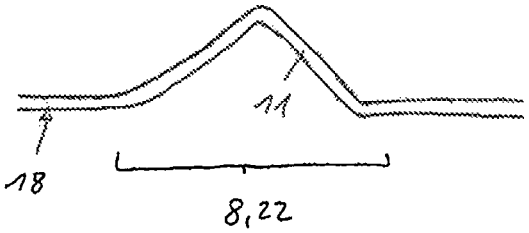

In detail, FIG. 9 shows a strip 11 doubly curved wave-like comprising a region 31 curved to the outside or protruding to the outside and a region 32 curved to the inside or protruding to the inside. FIGS. 10 and 11 each show a strip 11, which is bent zigzag-shaped or angled off. In FIG. 10 the strip 11 is bent or angled off to the outside, while in FIG. 11 it is angled off or bent to the inside. While the strip in FIGS. 10 and 11 each is only bent zigzag-shaped one-way, FIG. 12 shows a version wherein the strip 11 is bent or angled-off zigzag-shaped two-ways. With this embodiment, the strip 11 thus again has a region 31 bent to the outside or protruding to the outside and a region 32 bent to the inside or protruding to the inside.

With the embodiment shown here, the strips 11 each extend parallel to the longitudinal centre axis 9. Accordingly, the slits 12 also extend parallel to the longitudinal centre axis 9. In principle, however, embodiments wherein the strips 11 and accordingly also the slits 12 can extend inclined relative to the longitudinal centre axis 9, such that they extend for example thread-like and for example have a pitch, are also conceivable.

With all shown embodiments the strips 11 are integrally moulded on the respective pipe 5, 18. In principle, however, an embodiment wherein the strips 11 are separate components which are attached to the respective pipe 5, 18, is also conceivable.

The invention claimed is:

1. An exhaust gas treatment device for an exhaust system of a combustion engine, with a housing in which a first pipe is mounted on a second pipe longitudinally displaceable via a sliding seat, wherein one of the pipes in the sliding seat comprises a spring section, in which a wall of the respective pipe has a plurality of strips adjacent in circumferential direction, which with respect to a longitudinal centre axis of the respective pipe in the spring section radially bear against the other pipe in a spring-elastic manner.

2. The exhaust gas treatment device according to claim 1, wherein the plurality of strips are shaped so that they come to bear against the respective other pipe under preload.

3. The exhaust gas treatment device according to claim 2, wherein each of the plurality of strips comes to bear against the respective other pipe via a contact area which is smaller than the area of a respective one of the plurality of strips facing the respective other pipe.

4. The exhaust gas treatment device according to claim 3, wherein the contact area amounts to a maximum of 30% or a maximum of 25% or a maximum of 20% or a maximum of 10% of the area of the strip.

5. The exhaust gas treatment device according to claim 1, wherein the plurality of strips are formed in that the wall in the spring section in circumferential direction is interrupted by a plurality of slits penetrating the wall and the plurality of strips protrude with respect to adjacent wall sections of the respective pipe.

6. The exhaust gas treatment device according to claim 5, wherein the spring section is formed on the pipe located inside in the sliding seat and the plurality of strips protrude to the outside of the exhaust gas treatment device or in that the spring section is formed on the pipe located outside in the sliding seat and the plurality of strips protrude to the inside of the exhaust gas treatment device.

7. The exhaust gas treatment device according to claim 5, wherein the plurality of strips are curved wave-like or bent zigzag-shaped.

8. The exhaust gas treatment device according to claim 7 wherein the plurality of strips with respect to a longitudinal centre axis of the through-pipe in the expansion compensation section are curved or bent one-way to the outside of the exhaust gas treatment device or curved or bent one-way to the inside of the exhaust gas treatment device.

9. The exhaust gas treatment device according to claim 7 wherein the plurality of strips are multiply curved or bent and with respect to a longitudinal centre axis of the through-pipe in the expansion compensation section comprise at least one region curved or bent to the outside of the exhaust gas treatment device and at least one region curved or bent to the inside of the exhaust gas treatment device.

10. The exhaust gas treatment device according to claim 1, wherein the plurality of strips are formed in that in the spring section in the wall adjacent in circumferential direction a plurality of strip-shaped wall sections are cut free and flared out.

11. The exhaust gas treatment device according to claim 10, wherein the wall in the spring section in circumferential direction between adjacent flared-out strips comprises a further strip-shaped wall section each, which connects adjacent wall sections of the respective pipe with each other.

12. The exhaust gas treatment device according to claim 10, wherein the spring section is formed on a pipe located inside in the sliding seat and the plurality of strips are flared to the outside or that the spring section is formed on the pipe located outside of the exhaust gas treatment device in the sliding seat and the plurality of strips are flared to the inside of the exhaust gas treatment device.

13. The exhaust gas treatment device according to claim 10, wherein the flared-out strips are wave-shaped or curved.

14. The exhaust gas treatment device according to claim 10, wherein the plurality of strips are flared out on the leading side or the trailing side.

15. The exhaust gas treatment device according to claim 1, wherein a respective strip of the plurality of strips is only curved with respect to the longitudinal direction of the respective pipe, wherein a respective strip of the plurality of strips in the sliding seat contacts the respective other pipe linearly.

16. The exhaust gas treatment device according to claim 1, wherein a respective strip of the plurality of strips is curved with respect to the longitudinal direction of the respective pipe and with respect to the circumferential direction, wherein a respective strip of the plurality of strips in the sliding seat contacts the respective other pipe in the manner of a dot.

17. The exhaust gas treatment device according to claim 1, wherein the respective pipe distally to the sliding seat at a fastening point is connected to the housing in a fixed manner.

18. The exhaust gas treatment device according to claim 1, wherein one of the first and second pipes is formed by a pipe socket which is integrally molded on a wall of the housing.

19. The exhaust gas treatment device according to claim 1, wherein the exhaust gas treatment device is a silencer.

20. The exhaust gas treatment device according to claim 17, wherein the respective fastening point is formed through a welded connection.

21. The exhaust gas treatment device according to claim 1, wherein the plurality of strips extend parallel to a longitudinal centre axis of the respective pipe.

* * * * *